US010011962B2

(12) United States Patent
Bennett et al.

(10) Patent No.: US 10,011,962 B2
(45) Date of Patent: Jul. 3, 2018

(54) METHOD OF ENLARGING THE SPACE BENEATH A MASONRY ARCH BRIDGE, AND A MASONRY ARCH BRIDGE

(71) Applicant: SOLETANCHE FREYSSINET S.A.S., Velizy-Villacoublay (FR)

(72) Inventors: Kevin John Bennett, Buckinghamshire (GB); William John Harvey, Exeter (GB)

(73) Assignee: Soletanche Freyssinet S.A.S., Velizy-Villacoublay (FR)

( * ) Notice: Subject to any disclaimer, the term of this patent is extended or adjusted under 35 U.S.C. 154(b) by 0 days.

(21) Appl. No.: 15/308,010

(22) PCT Filed: May 1, 2015

(86) PCT No.: PCT/EP2015/059630

§ 371 (c)(1),
(2) Date: Oct. 31, 2016

(87) PCT Pub. No.: WO2015/166103

PCT Pub. Date: Nov. 5, 2015

(65) Prior Publication Data

US 2017/0067215 A1 Mar. 9, 2017

(30) Foreign Application Priority Data

May 2, 2014 (GB) ..... 1407868.7
Nov. 25, 2014 (GB) ..... 1420921.7
Feb. 4, 2015 (GB) ..... 1501828.6

(51) Int. Cl.
*E01D 22/00* (2006.01)
*E01D 4/00* (2006.01)

(52) U.S. Cl.
CPC ..... *E01D 22/00* (2013.01); *E01D 4/00* (2013.01)

(58) Field of Classification Search
CPC ..... E01D 22/00; E01D 4/00
(Continued)

(56) References Cited

U.S. PATENT DOCUMENTS 1,784,271 A * 12/1930 Collins ..... E03F 3/04 138/157
4,353,190 A * 10/1982 Gleeson ..... E04C 3/10 14/10

(Continued)

FOREIGN PATENT DOCUMENTS

CN 102704414 A 10/2012
EP 1 045 089 A1 10/2000

(Continued)

OTHER PUBLICATIONS

International Search Report of International Application No. PCT/EP2015/059630 dated Jul. 10, 2015, 3 pages.

(Continued)

*Primary Examiner* — Raymond W Addie
(74) *Attorney, Agent, or Firm* — Fay Sharpe LLP

(57) ABSTRACT

A method of enlarging the space beneath a masonry arch bridge which includes a masonry arch and a spandrel wall at each end of the masonry arch includes forming a movable portion of the masonry arch bridge by cutting the spandrel walls to form a cut on each side of the masonry arch. A lifting force is applied to the masonry arch to raise the masonry arch to a raised position. The masonry arch is then secured in the raised position.

19 Claims, 17 Drawing Sheets

(58) Field of Classification Search
USPC ..... 14/22–24, 77.1; 404/72
See application file for complete search history.

(56) References Cited

U.S. PATENT DOCUMENTS 4,558,969 A * 12/1985 Fitzsimons ..... E01D 19/04 405/124
4,890,993 A * 1/1990 Wilson ..... E04G 11/34 249/11
5,252,002 A * 10/1993 Day ..... E01F 5/005 405/124
5,380,123 A * 1/1995 Ryynanen ..... E01C 3/00 14/24
5,836,717 A * 11/1998 Bernini ..... E01D 4/00 405/124
6,243,994 B1 * 6/2001 Bernini ..... E02D 29/045 14/26
6,367,214 B1 * 4/2002 Monachino ..... E02D 27/02 52/247
6,640,505 B1 * 11/2003 Heierli ..... E02D 29/045 52/169.14
8,925,282 B2 * 1/2015 Aston ..... E02D 29/045 52/293.1
2004/0062609 A1 * 4/2004 Heierli ..... E02D 29/045 405/124
2007/0261341 A1 * 11/2007 Lockwood ..... E02D 29/045 52/380
2015/0322635 A1 * 11/2015 Aston ..... E01D 19/04 52/742.14

FOREIGN PATENT DOCUMENTS

GB 2 302 896 A 2/1997
JP 2010/185233 A 8/2010

OTHER PUBLICATIONS

Written Opinion of the International Searching Authority of International Application No. PCT/EP2015/059630 dated Jul. 10, 2015, 5 pages.
UKIPO Search Report of British Application No. 1407868.7 dated Oct. 1, 2014, 3 pages.
UKIPO Search Report of British Application No. 1420921.7 dated Mar. 27, 2015, 4 pages.
UKIPO Search Report of British Application No. 1501828.6 dated Oct. 1, 2015, 5 pages.

* cited by examiner

METHOD OF ENLARGING THE SPACE BENEATH A MASONRY ARCH BRIDGE, AND A MASONRY ARCH BRIDGE

The present invention relates to methods of enlarging the space beneath a masonry arch bridge, and to a masonry arch bridge.

Masonry arch bridges are commonly used in transport networks for spanning transport links, such as rail tracks. However, due to the limited space beneath them, existing masonry arch bridges can limit the size of vehicles used on such transport links. Further, they may inhibit modification of the transport links, such as the electrification of rail tracks. Thus, in order to increase the capacity of and to modify existing transport links, it can be necessary to enlarge the space beneath existing masonry arch bridges, or to demolish and rebuild such bridges.

It is often undesirable to demolish existing structures as they may be historically protected (e.g. in the UK, buildings may be placed on the Statutory List of Buildings of Special Architectural or Historic Interest).

Existing methods of enlarging the space beneath masonry arch bridges include lowering the ground beneath the bridge by digging. This technique can give rise to flooding problems. Further, in the rail industry, problems may arise with alignment with platform levels in the lowered region.

Further, both the demolish-and-rebuild, and ground-lowering techniques are expensive and disruptive to the transport network, since both necessarily lead to the spanned transport link being closed for significant lengths of time.

In one aspect the present invention provides a method of enlarging the space beneath a masonry arch bridge, the masonry arch bridge comprising a masonry arch and a spandrel wall at each end of the masonry arch, the method comprising forming a moveable portion of the masonry arch bridge by cutting the spandrel walls to form a cut on each side of the masonry arch, applying a lifting force to the moveable portion to raise the masonry arch to a raised position, and securing the masonry arch in the raised position.

No strengthening means may be applied to the masonry arch prior to lifting.

Alternatively strengthening means may be applied to the masonry arch prior to lifting.

In this context, strengthening means refers to a means which can be added to the bridge prior to lifting to strengthening the masonry arch. It may be a means external to the structure of the masonry arch.

In another aspect the present invention provides a method of enlarging the space beneath a masonry arch bridge, the masonry arch bridge comprising a masonry arch and a spandrel wall at each end of the masonry arch, the method comprising applying strengthening means to the masonry arch, applying a lifting force to the masonry arch to raise the masonry arch to a raised position, and securing the masonry arch in the raised position.

The method may further comprise, prior to applying the lifting force, forming a moveable portion of the masonry arch bridge by cutting the spandrel walls to form a cut on each side of the masonry arch.

In another aspect the present invention provides a masonry arch bridge comprising a masonry arch having an upper surface, a spandrel wall at each end of the masonry arch, and a strengthening means applied to the masonry arch.

Applying the strengthening means may comprise applying a compressive force to the masonry arch. The strengthening means may be provided above the masonry arch.

The strengthening means may be applied by anchoring one or more tendons relative to the masonry arch and applying a tensioning force to the tendon(s).

A first and a second tendon may overlap in the lateral direction in a region above the crown of the masonry arch. The tendons may generally be positioned above the masonry arch. Such a positioning both allows for the provision of a suitable compressive force, and allows vehicles or other traffic to pass under the bridge whilst the strengthening means is applied.

The tendon(s) may be anchored to the spandrel walls, parapets and/or to the masonry arch. One end of the tendon(s) may be anchored to one side of the crown, the other end of the tendon(s) may be anchored to the other side of the crown. The tendon(s) may be upwardly inclined in an inward lateral direction. The tendon(s) may be positioned in such a direction to maintain a sufficiently stabilising compression force in the masonry arch when the lifting force is applied. One (set of) tendon(s) may extend from an upper anchor position on a first side of the crown and another (set of) tendon(s) may extend from an upper anchor position on a second side of the crown, laterally opposite to the first side. The (sets of) tendon(s) may extend to respective lower anchor positions. The upper anchor positions may be live ends, the lower anchor positions may be dead ends. The angle of each tendon to the horizontal may be approximately equal.

The masonry arch bridge may comprise one or more inner spandrel walls. Further tendon(s) may be applied to the inner spandrel wall(s).

The strengthening means may comprise one or more devices, e.g. jacks, being located and orientated to apply a force to the masonry arch, the force having at least a component in the horizontal direction. The devices may act in compression. The devices may be orientated such that the force comprises at least a component in the lateral direction of the masonry arch. The devices may provide a force that is substantially only in the horizontal, lateral direction, with respect to the masonry arch. The devices may extend in the horizontal, lateral direction, with respect to the masonry arch. The one or more devices may be located at or within the cut(s) in the masonry arch. Where the cut extends in the longitudinal direction of the masonry arch (see below) the devices may be spaced evenly along the cut. The cored holes may be formed, and the devices may then be inserted into the cored holes. The devices may be loaded, before or after the cut is formed. If loaded before, this can reduce the stress on the masonry during cutting. The cored holes may have diameters of around 400-500 mm, preferably 450 mm. The centres of adjacent cored holes may be separated by approximately 1 m. The cored holes may be sized and spaced such that at least one ring of brickwork may be left beneath the cored holes (e.g. between the cored holes and the underside surface of the masonry arch). The one or more devices may at least partially maintain, or may increase, the thrust originally present due to arch action.

The strengthening means may comprise a saddle. The saddle may be applied to an upper surface of the masonry arch. The saddle may be anchored to the masonry arch.

Applying the saddle to the upper surface of the masonry arch may comprise casting a reinforced concrete saddle to the upper surface of the masonry arch and allowing the concrete to cure. Further, applying the saddle to the upper surface of the masonry arch may comprise post-tensioning the reinforced concrete saddle. The post-tensioning, along with the adhesive qualities of concrete, allows the saddle to securely anchor to the upper surface of the masonry arch. To improve the anchoring, prior to applying the saddle, the upper surface of the masonry arch may be cleaned, for example by jet-washing. Anchoring may be provided and/or enhanced using mechanical anchors between the saddle and the masonry arch.

Application of the strengthening means reduces the destabilisation of the masonry arch which could occur when the lifting force is applied. When the lifting force is applied, the usually present gravitational compression forces, and hence arch action, in the masonry arch may be reduced.

Application of the saddle to the upper surface of the masonry arch helps to maximise the raised height of the masonry arch—applying the saddle to the underside of the arch would reduce the space beneath the arch. Further, this position of the saddle may allow for improved access for lifting means. Further, in this position the saddle will not cover any of the external masonry, thus not largely affecting the appearance of the masonry arch bridge. Further, the majority of the steps of the method may be carried out whilst vehicles can still pass under the bridge. Thus, down-time of the transport network is minimised. This is in contrast to ground-lowering or rebuilding techniques where the transport network is necessarily disrupted for significant amounts of time.

The spandrel walls are located at the longitudinal ends of the masonry arch. The spandrel walls may extend to adjacent masonry arches, the top of the masonry bridge and/or the foundations of the masonry bridge. The spandrel walls may be considered to be the end walls of the masonry arch bridge.

A lateral direction may be defined as being perpendicular to the longitudinal direction of the masonry arch in the horizontal direction.

Forming the moveable portion reduces the mass required to be lifted. The cuts may be made laterally outwardly of the crown of the arch. Further, the cuts may be made laterally outward of the entire arch. The cuts may be made intermediate the crown of the arch and the laterally outward periphery of the arch. Thus, the entire bridge or arch need not be lifted. Cutting of the masonry arch bridge may be achieved by wire sawing, or preferably diamond sawing or coring, to provide clean cuts. Cutting of the masonry bridge may also be achieved by splitting the masonry, for example using masonry wedges.

The method may also comprise cutting the masonry arch adjacent the cuts in the spandrel walls to form the moveable portion. These cuts may extend along the masonry arch in a longitudinal direction. This may be necessary, for example, when the cuts in the spandrel walls are made intermediate the crown and the laterally outward edge of the masonry arch.

During lifting, shim wedges may be inserted into the cuts and/or jacking pockets to support the masonry arch. Such shim wedges can be used in any of the embodiments of the present invention to support the masonry arch when gaps are formed at the cuts during lifting. The shims may preferably be around 50 mm in thickness.

In certain aspects, no strengthening means is necessary.

During lifting, the lifting force may be applied such that arch action of the masonry arch is sufficiently maintained to ensure that the masonry arch maintains its structural integrity.

The lifting force may be provided at a lower portion of the masonry arch.

At least a component of the lifting force may act to compress the masonry arch.

Thus, external strengthening may not be needed during the lifting process. Rather, the method may rely on the natural arch action of the masonry arch and/or compression due to the lifting force.

The lifting force may be provided by one or more lifting devices.

The lifting force may be provided by one or more tensile members connecting the masonry arch to a support structure positioned above the masonry arch. Further, the support structure may span the masonry arch. The support structure preferably spans the masonry arch in its lateral direction. The support structure may span the arch in its longitudinal direction. The tensile member(s) may comprise lifting strands or lifting bars. The support structure may comprise a truss or a support beam. The tensile member(s) may be connected directly to the masonry arch, preferably to a lower portion of the masonry arch. The tensile member(s) may be connected to the strengthening means. The support structure may be supported on support structure foundations which may be installed in the embankments at the lateral sides of the masonry arch bridge. The truss may be a modular truss. The truss may comprise upper and lower bracing portions. The lower bracing portions may be removable from the truss to ease access to the masonry arch. The lower bracing portion may be applied to the truss prior to the lifting force being applied.

The lifting force may be applied via jacks. The jacks may be located at foundations of the support structure, and hence lift the support structure, the tensile member(s) and the moveable portion. The jacks may be ram jacks. Alternatively or additionally, the jacks may be located in the cut(s) in the masonry arch bridge. The jacks may be inclined.

Alternatively, the tensile member(s) may comprise the jacks, e.g. when the tensile member is a strand, the strand may comprise a strand jack. In this case, the support structure may remain static throughout the lift.

The saddle may comprise a lifting beam, the tensile member(s) being connected to the lifting beam. The lifting beam may be a beam extending in the longitudinal direction of the saddle. The lifting beam may have anchor points to which the tensile member(s) may be attached. Two lifting beams may be provided, one disposed on each side of the crown of the saddle. The two lifting beams may be disposed symmetrically on each side of the crown of the saddle.

The moveable portion and the tensile members may be symmetric about the crown of the arch. The net lifting force may act through the centre of mass of the moveable portion, so as to avoid rotation of the moveable portion.

The saddle may comprise two sets of tendons, each set of tendons spanning between first and second live ends and to first and second dead ends respectively. The tendons may be spaced longitudinally from each other and extend generally in the lateral direction. The tendons may be evenly spaced in the lateral direction.

The first and second live ends of each set of tendons may extend longitudinally. The first and second live ends may be positioned at the crown of the saddle. This eases access to the live ends for tensioning. The first and second dead ends may be positioned at the lower portions of the sides of the saddle. The first live end may be positioned nearer the second dead end than the first dead end, and the second live end may be positioned nearer the first dead end than the second dead end. This allows the two sets of tendons to overlap at the crown of the saddle. Such an arrangement improves the post-tensioned qualities and anchoring of the saddle.

The masonry arch may be supported on respective piers at each side of the masonry arch, and the lifting force may be applied at the piers. The lifting force may be applied using jacks, preferably ram jacks. The jacks may be housed in the piers in jacking pockets, which may be formed by cutting or coring into the piers.

Securing the masonry arch in the raised position may comprise grouting or filling the gaps formed when the masonry arch is lifted. Once the masonry arch has been secured, the lifting force may be removed.

In one embodiment, the moveable portion of the masonry arch bridge, when raised, may undergo linear vertical movement, i.e. with no rotation. In this embodiment, the moveable portion may comprise the masonry arch and a portion of the masonry arch bridge substantially vertically above the masonry arch.

In this embodiment, the cuts may be substantially vertical. In this case horizontal cuts may also be made between the side of the arch and the vertical cut. When such cuts are made and the masonry arch is raised, a gap will form in the location of each of the horizontal cuts. To secure the masonry arch in the raised position, this gap may be grouted or filled.

The cuts may be upwardly inclined in the laterally outward direction. In this case, no horizontal cuts may be necessary. When such cuts are made and the masonry arch is raised, a gap will form in the location of each of the upwardly inclined cuts. To secure the masonry arch bridge in the raised position, this gap may be grouted or filled.

In another embodiment, the moveable portion of the masonry arch bridge, when raised, may undergo rotational movement. This may be achieved with or without using the saddle.

When using the saddle, the saddle may comprise a first saddle portion and a second saddle portion, and the first saddle portion may be applied to a first portion of the masonry arch and the second saddle portion may be applied to a second portion of the masonry arch. The masonry arch may consist of the first portion and the second portion of the masonry arch. Preferably, the first and second saddle portions may meet at the crown of the masonry arch. The first and second saddle portion may each be applied to one half of the upper surface of the masonry arch, i.e. one side from the base of the arch to the crown.

The first and second saddle portions may each comprise a set of tendons spanning between a live end and a dead end. The tendons may be spaced longitudinally from each other and extend in the lateral direction. The tendons may be evenly spaced.

The live and dead ends of the set of tendons may extend longitudinally. The dead end may be positioned at the crown of the saddle. The live end may be positioned at the lateral periphery of the saddle portion. The tendons may be upwardly inclined in a laterally inward direction from the outer periphery to the crown of the saddle. Such an arrangement improves the post-tensioned qualities and anchoring of the saddle.

The concrete saddle may be cast such that the upper surface of saddle is approximately at the original road level. Such an arrangement reduces the need for re-profiling the road surface once the masonry bridge has been raised.

Regardless of whether the saddle is used, the method may further comprise, prior to applying the lifting force, forming wedge-shaped gaps in the spandrel walls laterally outward of the masonry arch; and forming a first and second moveable portion by cutting through the masonry arch.

Preferably, when the saddle is used, the masonry arch may be cut in the location where the first and second saddle portions meet.

Preferably, regardless of whether the saddle is used, the masonry arch may be cut at the crown of the masonry arch. Further, horizontal cuts may be formed in the piers.

When the first and second moveable portions are formed and the lifting force is applied, the first and second moveable portions may pivot about respective first and second pivot points. The first and second pivot points may be located at a position laterally outwardly from the masonry arch. This position could be, for example, where the masonry arch bridge meets the embankment. This position may be at or near where the masonry arch meets the piers. This position could be within additional masonry arches that are laterally outward of the masonry arch (see below), for example in a three-span bridge the position could be located in the outer (side) masonry arches, approximately one-quarter of the span of the outer masonry arches from the outer lateral extremity of the outer masonry arches. In order for the first and second moveable portions to pivot, the lifting force should be applied to the respective first and second portions at positions laterally inward of the centre of mass of the first and second portions.

The tip of the wedge-shaped gap should be positioned at the pivot point. The angle of the wedge-shaped gap should be sufficiently large to allow the first and second moveable portions to sufficiently rotate to enlarge the space the masonry arch bridge as desired.

The step of securing the masonry arch bridge may comprise inserting or forming a wedge between the first and second bridge portions. Further, the gap formed in the location of the horizontal cut may be grouted or filled.

Any masonry, mortar, concrete or grout used to secure the bridge in its lifted position, e.g. the grout filling the cuts, gaps or wedge-shaped gaps, may be applied and then may be left to cure, e.g. for around 24 hours. The application and/or curing may occur whilst the lifting force and/or strengthening means remain being applied to the masonry arch. Once applied/cured, the strengthening means and/or lifting force can be removed.

An advantage of pivoting the moveable portions in this manner is that the road surface need not be re-profiled after the masonry arch bridge has been secured, since the road surface is already inclined due to the rotation.

In one embodiment, the masonry arch bridge may be a single-span masonry arch bridge.

In another embodiment, the masonry arch bridge may be a multi-span masonry arch bridge comprising one or more additional masonry arches and respective one or more piers between adjacent masonry arches, and the strengthening means may be applied to the additional masonry arch(es).

The multi-span masonry arch bridge thus comprises a plurality of masonry arches. Adjacent masonry arches may share, and hence may be separated by, respective piers. The wedge-shaped gaps in the spandrel walls may be located laterally outward of the outer-most masonry arches. The outer-most masonry arches are the two masonry arches which are furthest from the centre of the masonry arch bridge in the lateral direction. Alternatively, the wedge-shaped gaps may be located between adjacent masonry arches. Alternatively, the wedge-shaped gaps may be located within the outer, or outermost, masonry arches, for example in a three-span bridge the location could be located in the outer masonry arches, approximately one-quarter of the span of the outer, or outermost, masonry arches from the outer lateral extremity of the outer, or outermost, masonry arches.

The masonry arch discussed in relation to the present invention may be any one of the plurality of masonry arches. The invention may be applied to one or more of the masonry arches.

The multi-span masonry arch bridge may consist of two masonry arches. The two masonry arches may be considered to be the outer-most arches.

The multi-span masonry arch bridge may consist of an odd number of masonry arches. In this case, the masonry arch discussed in relation to the present invention may be a central masonry arch.

The multi-span masonry arch bridge may comprise one or more first side masonry arches to one side of the central masonry arch, and one or more second side masonry arches to the other side of central masonry arch. The number of first and second side masonry arches may be the same. The first and second side masonry arches may correspond to one another such that the masonry arch bridge is symmetric about the crown of the central masonry arch. A pier may be located between and may support adjacent masonry arches. In the art, side masonry arches may be known as back arches.

The cut may be formed in the central arch, preferably at the crown.

For example, the multi-span masonry arch bridge may be a three-span masonry arch bridge. The three-span masonry arch bridge may comprise first and second side masonry arches, a first pier adjacent to the central masonry arch and the first side masonry arch, and a second pier adjacent to the central masonry arch and the second side masonry arch.

In this case, the first saddle portion may be applied to the upper surface of the first side masonry arch and a portion of the central masonry arch, and the second saddle portion may be applied to the upper surface of the second side masonry arch and the remaining portion of the central masonry arch.

The one or more devices located and orientated to apply a force to the masonry arch, the force having at least a component in the horizontal direction may be located in the cut in the central arch.

The wedge-shaped gaps in the spandrel walls may be located laterally outward of the first and second side arches. Alternatively, the wedge-shaped gaps may be located within the first and second side arches. For example, the wedge-shaped gaps may be formed in the first and/or second side arches approximately one-quarter of the span of the first/second side arch from the outer lateral extremity of the first/second side arch respectively.

The wedge-shaped gaps may be alternatively be replaced by cuts, for example if the spandrel wall is sufficiently small or if the geometry of the masonry arch bridge so allows.

Additionally or alternatively, the method may comprise providing a bearing in the cut.

There may be one or more bearings. The bearing may be provided at the laterally outward side of the moveable portion. The bearing may act to maintain compression, and hence arch action, of the masonry arch during lifting. The bearing may reduce friction during the lift. The bearing may maintain the structural form of the bridge with or without providing compression (e.g. by preventing cut masonry crumbling). The bearing may be provided between a first surface formed on the moveable portion and a second surface formed on the remainder of the bridge adjacent the first surface. The surfaces may be planar. The surfaces may be vertical. The surfaces may extend in the longitudinal direction of the masonry arch bridge. The bearing surfaces may or may not be provided along substantially the entire longitudinal length of the cut. The bearing surfaces may or may not extend along substantially the entire depth of the cut. The longitudinal length of the cut is a horizontal direction generally parallel with the longitudinal direction of the arch.

The cut may comprise one or more cored holes. The cored hole(s) may be substantially vertical. The cored hole(s) may have a generally circular cross-sectional shape. The cored holes may be positioned adjacent one another, and may form substantially the entire longitudinal length of the cut. The cored holes may be spaced from one another. The cored holes may be discrete and joined by a cut through the masonry.

A bearing may be located in (each of) the cored hole(s), or may be located on only some of the cored holes.

The bearing may comprise two planar portions which may be substantially identical to one another. The width of the planar portions may be substantially the same as the diameter of the cored hole(s).

The length of the planar portions may be substantially the same as the depth of the cored hole(s).

The length of the planar portions may be greater than the depth of the cored hole(s).

The length of the planar portions may be less than the depth of the cored hole(s). In use, the planar portions may be located at a lower portion of the cored hole(s). The bearing may further comprise one or more extension portions configured to extend from the planar portions and out of the cored hole. The extension portion(s) can allow the bearing to be inserted into, removed from and positioned within the cored hole. In use, the extension portion(s) may extend in a generally vertical direction.

The bearing may comprise a friction reducing means. The friction reducing means may be located between the first and second surfaces. The friction reducing means may have an area that is substantially similar to that of the planar portions. The friction reducing means may be attached to one or neither of the surfaces. The friction reducing means may be grease. The grease may be provided in a layer. The friction reducing means may comprise a layer of PTFE. The first and second surfaces may be stainless steel surfaces. The planar portions may be stainless steel layers.

The bearing may comprise a means for protecting the surfaces of the bearing. The means may be a protective layer, and may be positioned between the two surfaces. The protective means may be resilient. The protective means may protect the surfaces from damage. The protective means may provide the friction reducing means.

The bearing may be attached to the moveable portion and/or the remainder of the bridge by grout/concrete. The bearing may be attached to the moveable portion and/or the remainder of the bridge using pegs. The pegs may be embedded in the concrete/grout. The bearing may be positioned in the cored hole, and the grout/concrete may then poured into the cored hole and allowed to set around the pegs.

Each bearing may have vertical dimension of about 100 mm to 4000 mm, preferably 500 mm or 4000 mm, and a horizontal dimension of about 150 mm to 500 mm, preferably 300 mm.

The moveable portion may be lifted about 250 mm to 1000 mm, preferably 500 mm.

The bearing may contain a material (e.g. rubber) or a hydraulic device to accommodate minor mis-alignment of the bearing with respect to the intended slip plane whilst still maintaining pressure across the slip plane.

Prior to applying the strengthening means and/or forming the moveable portion, a shield may be applied to the masonry arch bridge. Debris netting may be applied to the masonry arch bridge. This will increase the safety of the overall procedure and will mean that people, cars, trains, etc. will be able to pass beneath the bridge while the majority of the work is conducted. The shield may be formed of steel. The shield may have a thickness of less than 15 mm so as to be accommodated in typical working clearance. The shield and/or netting may be recoverable for use on further masonry arch bridges. The shield may be positioned underneath the masonry arch. The shield may be supported on the ground beneath the masonry arch. The shield may have an arch shape. The shape may generally follow the shape of the masonry arch, such that the tracks/roadway underneath the arch may be used whilst the present method is carried out. There may be a small gap separating the masonry arch and the shield. The shield may extend beyond the longitudinal extremity of the bridge.

Also, masonry arch bridge parapets and the spandrel walls may be braced to ensure they remain intact during the work. Alternatively, the parapets may be removed. Further, the existing masonry bridge fill material may be excavated to uncover the masonry arch; any non-excavated bridge fill material may be battered back.

Certain preferred embodiments will now be described by way of example only and with reference to the accompanying drawings, in which FIGS. 1 to 9 illustrate the steps of an embodiment of the present invention;

Figure 1:
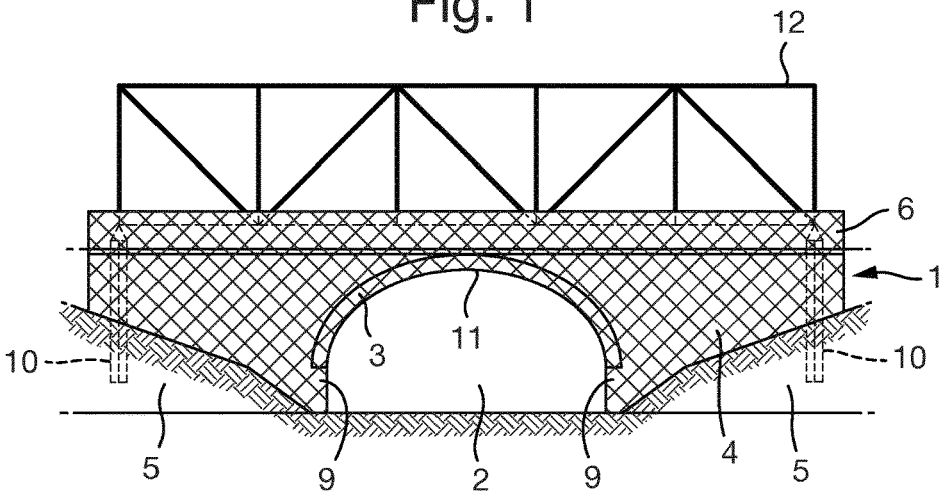

Regarding the first embodiment, FIG. 1 shows a single-span masonry arch bridge 1 and a space 2 beneath the masonry arch bridge. The masonry arch bridge 1 comprises a masonry arch 3, a spandrel wall 4 at each end of the masonry arch 3, and a parapet 6 above each spandrel wall 4 and the masonry arch 3. The masonry arch 3 is supported on respective piers 9 at each side of the masonry arch 3. The masonry arch bridge is supported by embankments 5. Between the spandrel walls 4, the embankment 5 and the masonry arch 3, the masonry arch bridge is filled with fill material.

The first phase of the method comprises installing lifting truss foundations 10 in the fill material and the embankments 5, installing debris netting and shield 11 to the masonry arch 3 and the masonry arch bridge 1 and installing a truss 12 on the truss foundations 10.

Figure 2:
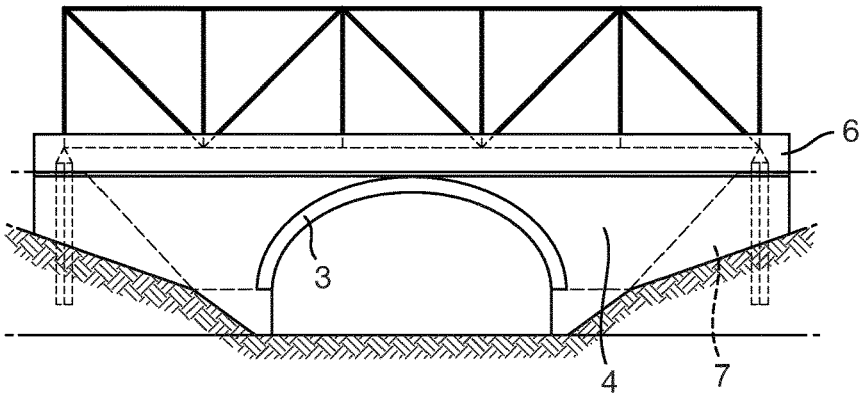

With reference to FIG. 2, the method further comprises bracing the parapets 6, bracing the spandrel walls 4, excavating the fill material to uncover the masonry arch 3, and battering back the remaining fill material 7. It should be noted that the masonry arch may heave when excavation occurs.

Figure 3:
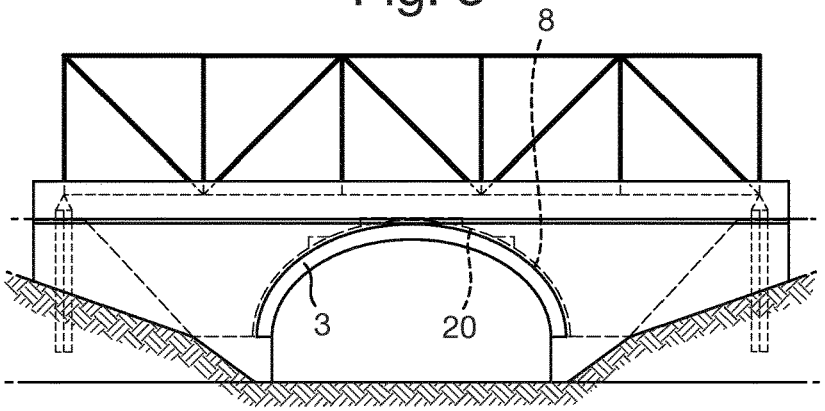

With reference to FIG. 3, the method comprises further jetwashing the upper surface 8 of the masonry arch 3, casting a reinforced concrete saddle 20 onto the upper surface 8 of the masonry arch 3 and allowing the concrete to cure.

Figure 4:
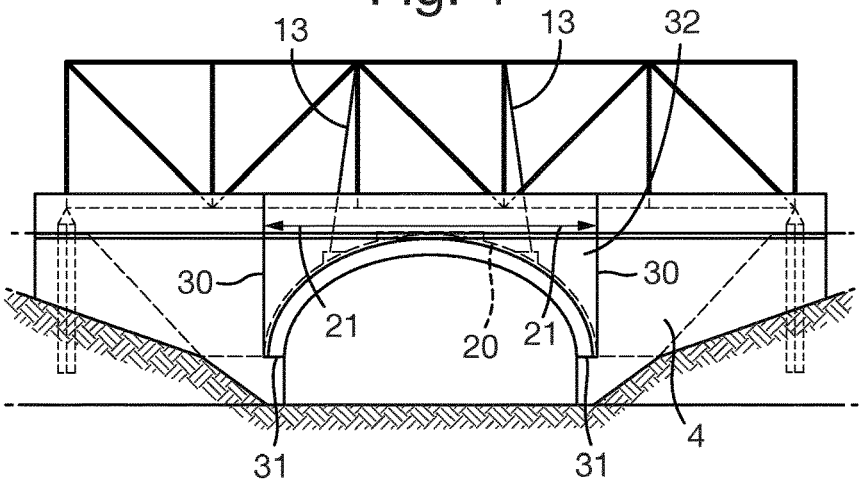

With reference to FIG. 4, the method further comprises post-tensioning 21 the reinforced concrete saddle 20, installing lifting strands 13, cutting spandrel walls to form vertical or near-vertical cuts 30 and cutting the piers 9 to form horizontal cuts 31, thus forming a moveable portion 32 of the masonry arch bridge 1.

Figure 5:
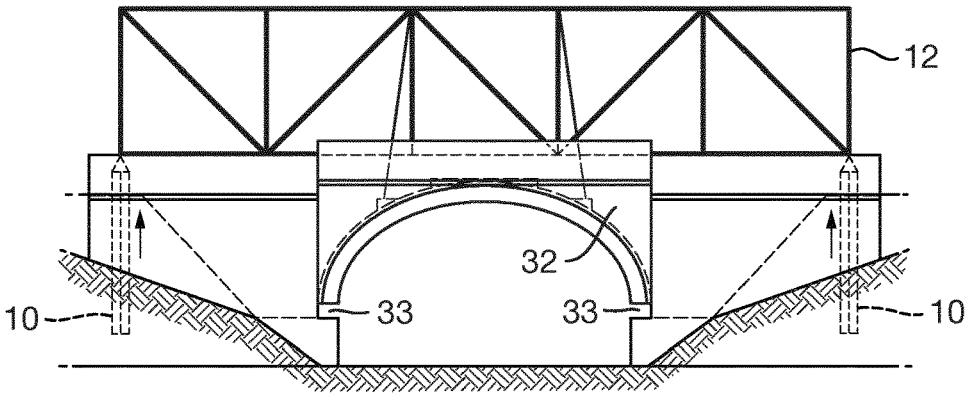

With reference to FIG. 5, the method further comprises jacking the truss foundations 10 at the location where the truss 12 meets the truss foundations 10, thus lifting the moveable portion 32 to the desired height. A gap 33 is formed at the location of the horizontal cut 31.

Figure 6:
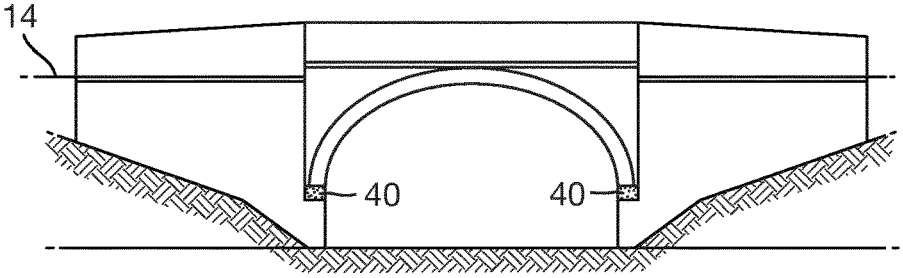

With reference to FIG. 6, the method further comprises installing masonry, mortar and/or grout 40 to fill gap 33, allowing this to cure, de-jacking the truss 12, removing the truss 12, removing the truss foundations 10 and backfilling the excavated region, preferably with foamed concrete, the previously excavated material or new graded backfill material. The road level 14 may be adjusted to a suitable level.

Figure 7:
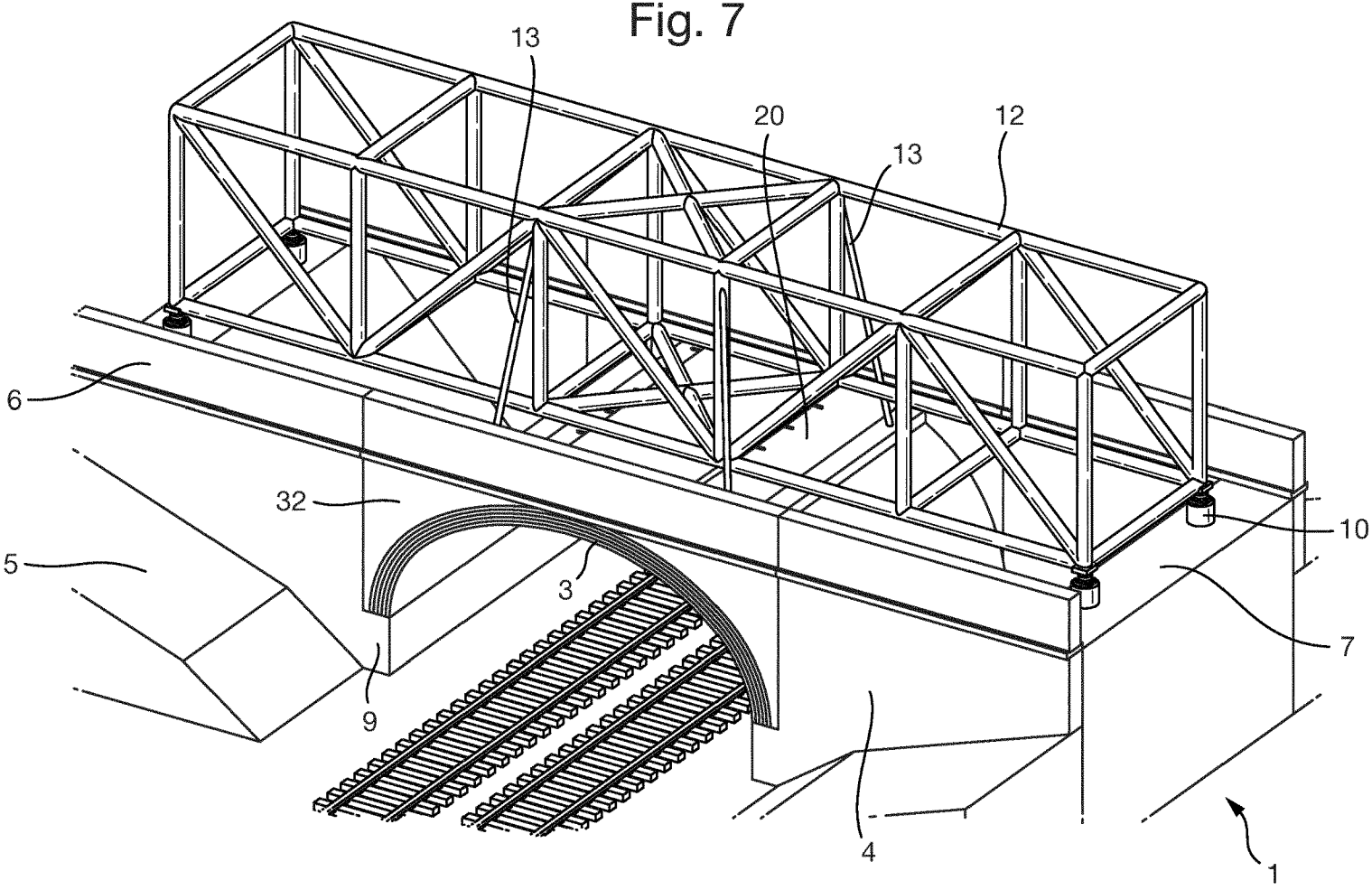

FIG. 7 provides another view of the excavated masonry bridge 1, showing the masonry arch 3, the spandrel walls 4, the parapets 6, the piers 9, the embankments 5, the remaining fill material 7, the truss foundations 10, the truss 12, the lifting strands 13, the saddle 20 and the moveable portion 32.

Figure 8:
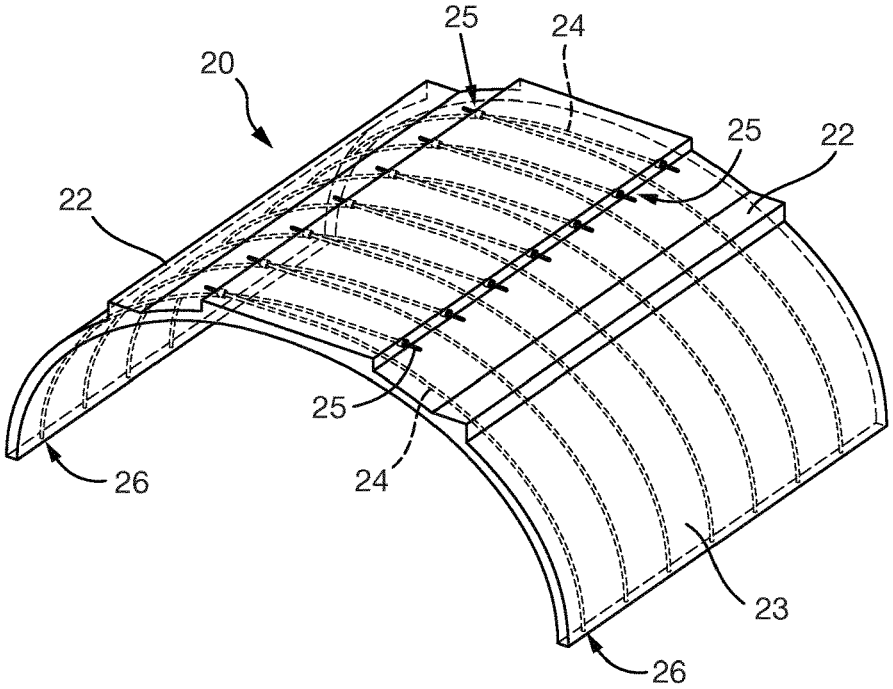

FIG. 8 shows the reinforced concrete saddle 20 in more detail. The saddle 20 comprises two lifting beams 22 to which the lifting strands 13 are connected. The lifting beams 22 extend in the longitudinal direction of the saddle 20. The two lifting beams 22 are disposed on each side of the crown of the saddle 20, equidistant from the crown. The saddle comprises mechanical anchors 23 to provide and/or enhance anchoring between the saddle 20 and the masonry arch 3.

The saddle comprises two sets of tendons 24 connecting first and second live ends 25 to first and second dead ends 26 respectively. The tendons 24 are spaced longitudinally from each other and extend in the lateral direction. The tendons 24 are evenly spaced.

The first and second live ends of each set of tendons 24 extend longitudinally. The first and second live ends 25 are positioned at the crown of the saddle 20. The first and second dead ends are positioned at the lower portions of the sides of the saddle. The first live end 25 is positioned nearer the second dead end 26 than the first dead end 26, and the second live end 25 is positioned nearer the first dead end 26 than the second dead end 26. This allows the two sets of tendons 24 to overlap at the crown of the saddle 20.

Figure 9:
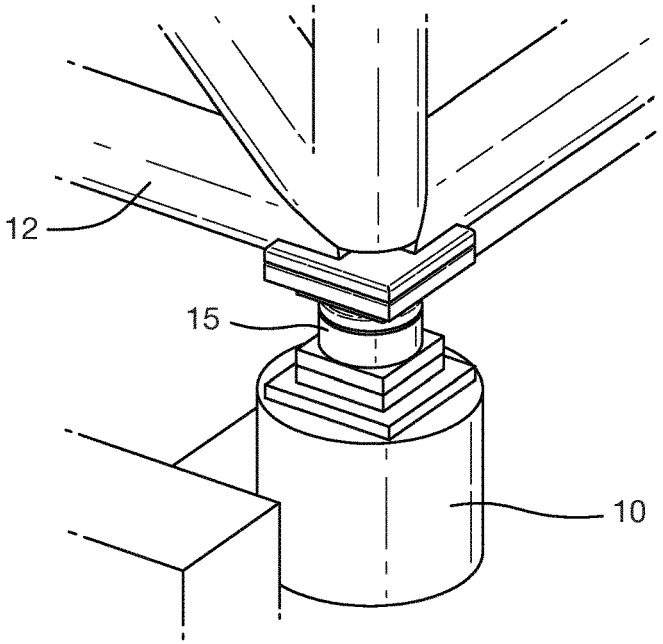

FIG. 9 shows the truss jacking mechanism in more detail. A jack 15 is positioned between the truss foundation 10 and the truss 12.

Figure 10:
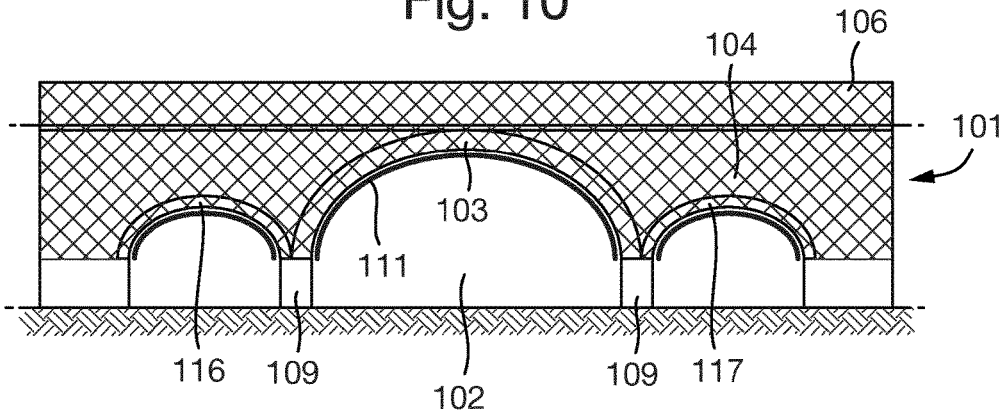
FIGS. 10 to 17 illustrate the steps of another embodiment of the present invention.

Regarding the second embodiment, FIG. 10 shows a three-span masonry arch bridge 101 and a space 102 beneath the masonry arch bridge 101. The masonry arch bridge 101 comprises a central masonry arch 103, a first side masonry arch 116, a second side masonry arch 117, a spandrel wall 104 at each end of the central masonry arch 103, and a parapet 106 above each spandrel wall 104. The central masonry arch 103 is supported on respective piers 109 at each side of the central masonry arch 103. Between the spandrel walls 104 and the central masonry arch 103, the first masonry side arch 116 and the second masonry side arch 117, the masonry arch bridge 101 is filled with fill material.

The first phase of the method comprises installing debris netting and shield 111 to the masonry arch bridge 101

Figure 11:
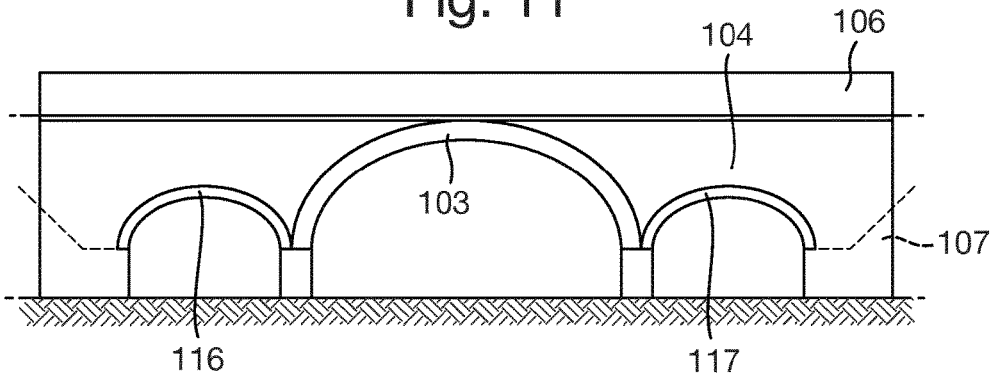

With reference to FIG. 11, the method further comprises bracing the parapets 106, bracing the spandrel walls 104, excavating the fill material to uncover the central masonry arch 103, the first masonry side arch 116 and the second masonry side arch 117, and battering back the remaining fill material 107. It should be noted that the masonry arches may heave when excavation occurs.

Figure 12:
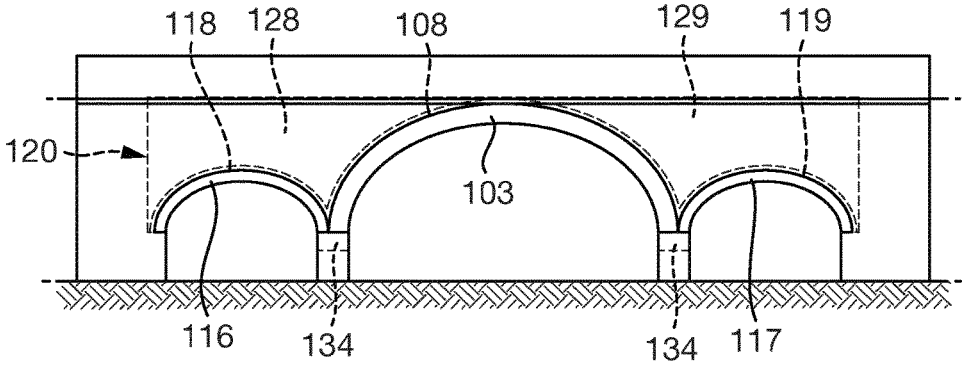

With reference to FIG. 12, the method comprises further jetwashing the upper surfaces 108, 118, 119 of the central masonry arch 103 and the first and second masonry side arches 116, 117, casting a reinforced concrete saddle 120 onto the upper surfaces 108, 118, 119 and allowing the concrete to cure. The reinforced saddle has two saddle portions 128, 129. Further, jacking pockets 134 are formed in the piers 109.

Figure 13:
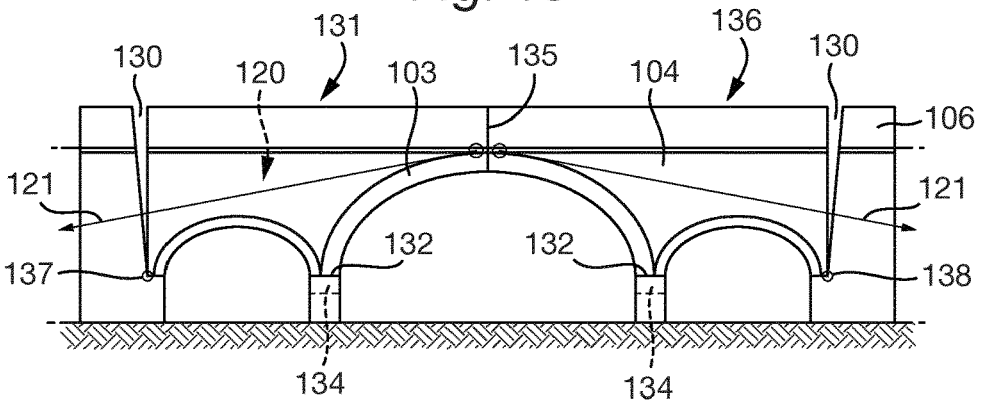

With reference to FIG. 13, the method further comprises post-tensioning 121 the reinforced concrete saddle 120, cutting spandrel walls 104 and parapets 106 to form vertical cuts or wedge-shaped gaps 130, cutting the piers 109 at the location of the jacking pockets 134 to form horizontal cuts 132, cutting the central masonry arch 103 and the parapets 106 at the crown to form vertical cut 135, thus forming first and second moveable portions 131, 136 of the masonry arch bridge 101.

Figure 14:
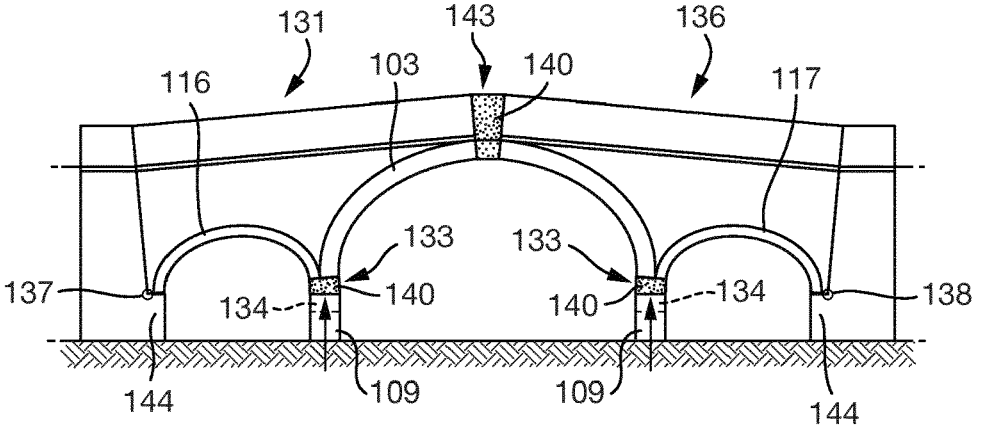

With reference to FIG. 14, the method further comprises jacking the first and second moveable portions 131, 136 using jacks 115 (see FIG. 26) located in the jacking pockets 134. The first and second moveable portions 131, 136 pivot about respective first and second pivot points 137, 138. The first and second pivot points 137, 138 are located at a position laterally outwardly from the side masonry arches 116, 117. This position may be at or near where the side masonry arches 116, 117 meet outer piers 144. The tip of each wedge-shaped gap 130 is respectively positioned at each pivot point 137, 138.

Upon lifting, gaps 133 are formed between the masonry arches 103, 116, 117 and the piers 109. A crown gap 143 is also formed between the two movable portions 131, 136. Further, in addition to the jacks, shim wedges (not shown) may be inserted into the cuts 132 and/or jacking pockets 134 adjacent the jacks to support the masonry arch during lifting. Such shim wedges can be used in any of the embodiments of the present invention (e.g. regardless of whether jacks are used) to support the masonry arch when gaps are formed at the cuts during lifting. The shims may preferably be around 50 mm in thickness.

A wedge, masonry, mortar and/or grout 140 is installed to fill gaps 133, 143. This is allowed to cure and the jacks 115 are de-jacked. The jacking pockets 134 can then be filled.

Figure 15:
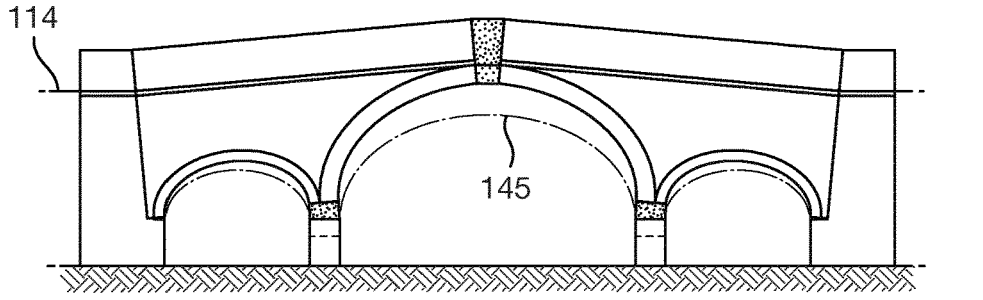

With reference to FIG. 15, the method further comprises backfilling the excavated region, preferably with foamed concrete. The road level 114 may be adjusted to a suitable level. The original profile 145 of the bridge can be seen as being lower than the raised profile.

Figure 16:
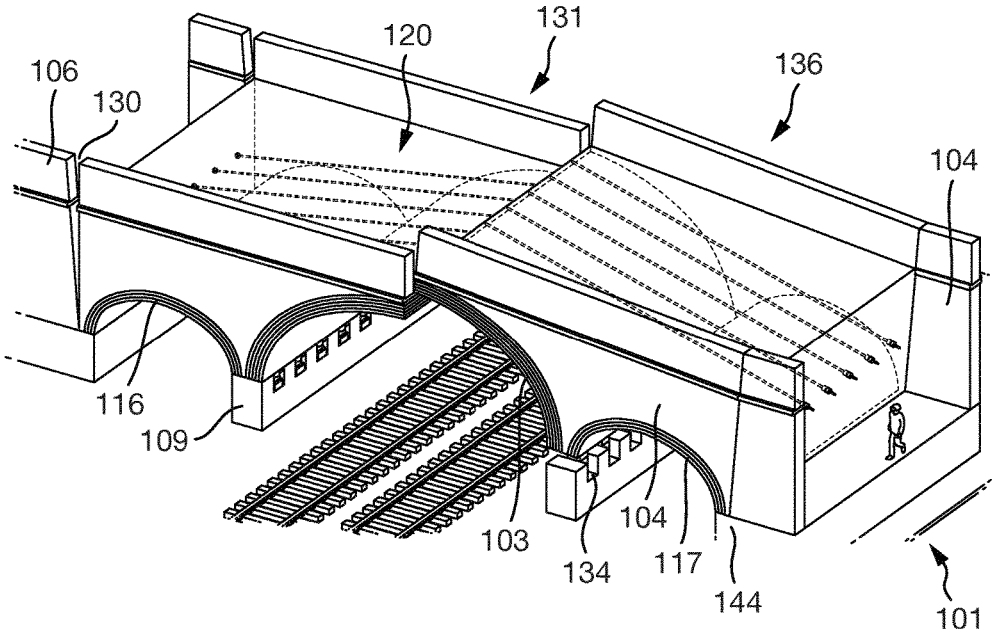

FIG. 16 provides another view of the excavated masonry bridge 101, showing the central masonry arch 103, the first side masonry arch 116, the second side masonry arch 117, the spandrel walls 104, the parapets 106, the piers 109, the outer piers 144, the jacking pockets 134, the saddle 120, the moveable portions 131, 136 and the wedge-shaped gaps 130.

Figure 17:
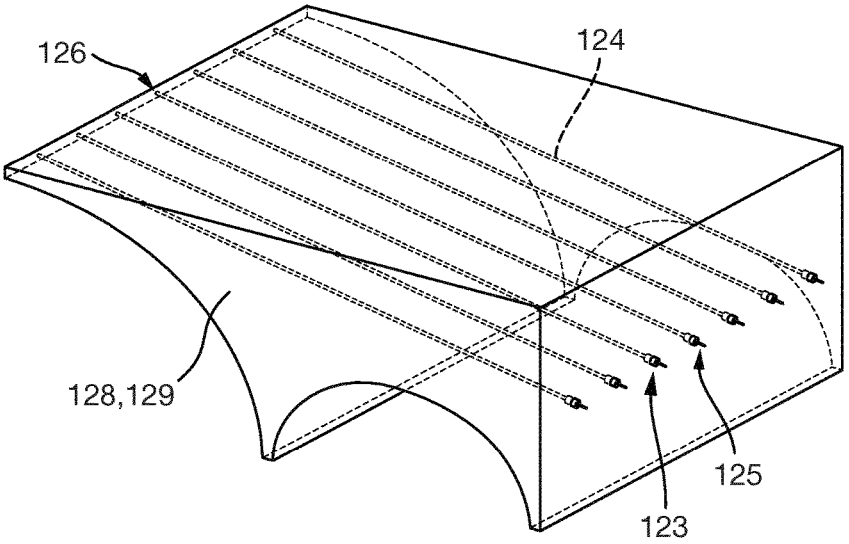

FIG. 17 shows one of the reinforced portions 128, 129 of the concrete saddle 120 in more detail. The saddle comprises mechanical anchors 123 to provide and/or enhance anchoring between the saddle 120 and the central and side masonry arches 103, 116, 117.

The saddle portion 128, 129 comprises a set of tendons 124 connecting live end 125 to dead end 126. The tendons 124 are spaced longitudinally from each other and extend in the lateral direction. The tendons 124 are evenly spaced.

The live and dead ends 125, 126 of the set of tendons 124 extend longitudinally. The dead end 126 is positioned at the crown of the saddle 120. The live end 125 is positioned at the lateral periphery of the saddle portion 128, 129. The tendons 124 are upwardly inclined in a laterally inward direction from the outer periphery to the crown of the saddle 120.

The concrete saddle 120 is cast such that the upper surface of saddle 120 is approximately at the original road level 114.

Figure 18:
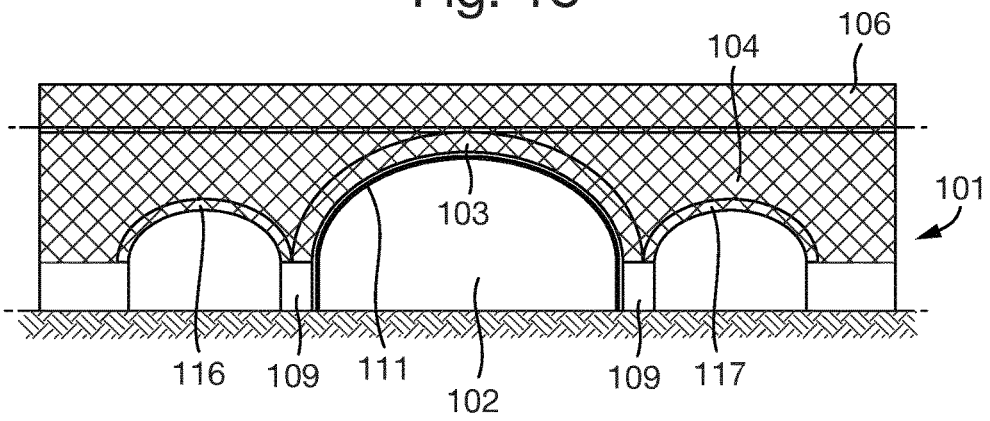
FIGS. 18 to 26 illustrate the steps of another embodiment of the present invention.

Regarding the third embodiment, similarly to the second embodiment, FIG. 18 shows a three-span masonry arch bridge 101 and a space 102 beneath the masonry arch bridge 101. The masonry arch bridge 101 comprises a central masonry arch 103, a first side masonry arch 116, a second side masonry arch 117, a spandrel wall 104 at each end of the central masonry arch 103, and a parapet 106 above each spandrel wall 104. The central masonry arch 103 is supported on respective piers 109 at each side of the central masonry arch 103. Between the spandrel walls 104 and the central masonry arch 103, the first masonry side arch 116 and the second masonry side arch 117, the masonry arch bridge 101 is filled with fill material.

The first phase of the method comprises installing debris netting and shield 111 to the masonry arch bridge 101. The shield can be seen in further detail in FIGS. 24 and 25. The shield has a shape that generally follows the shape of the masonry arch, such that the tracks underneath the arch may be used whilst the present method is carried out. The shield extends beyond the longitudinal extremity of the bridge. Such a shield can be used in any of the embodiments in the present invention, and can be used under any number or all of the masonry arches where multiple masonry arches are present.

Figure 19:
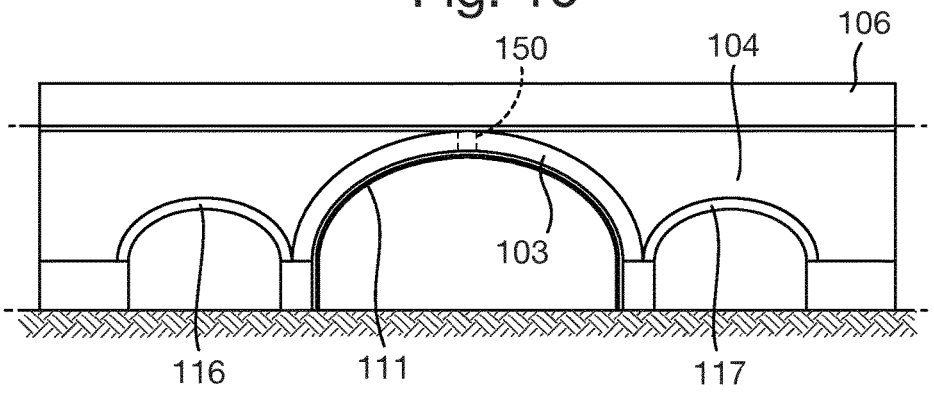

With reference to FIG. 19, the method further comprises bracing the parapets 106, bracing the spandrel walls 104, excavating the fill material to uncover the central masonry arch 103, the first masonry side arch 116 and the second masonry side arch 117, and battering back the remaining fill material 107. It should be noted that the masonry arches may heave when excavation occurs. Further, a plurality of cores 150 are formed at the crown of the central masonry arch 103. Inside these cores, horizontal jacks are installed.

Figure 20:
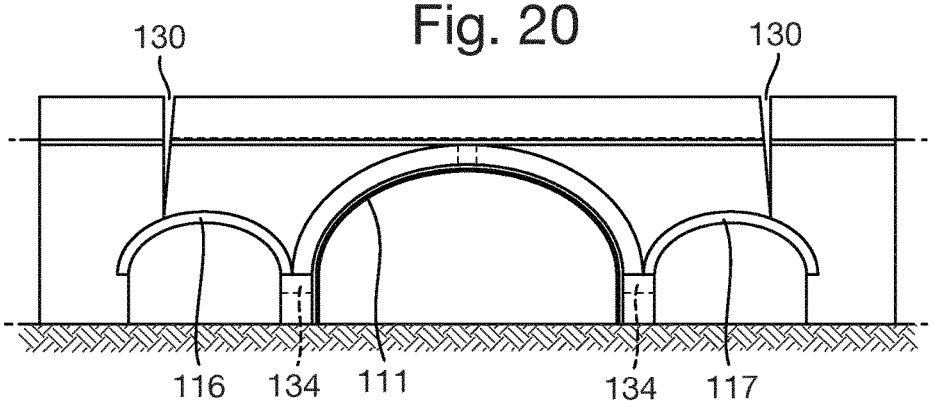

With reference to FIG. 20, jacking pockets 134 are formed in the piers 109 and rotation-clearance wedges 130 are cut in the two side arches 116, 117. Jacks are installed into jacking pockets 134.

Figure 21:
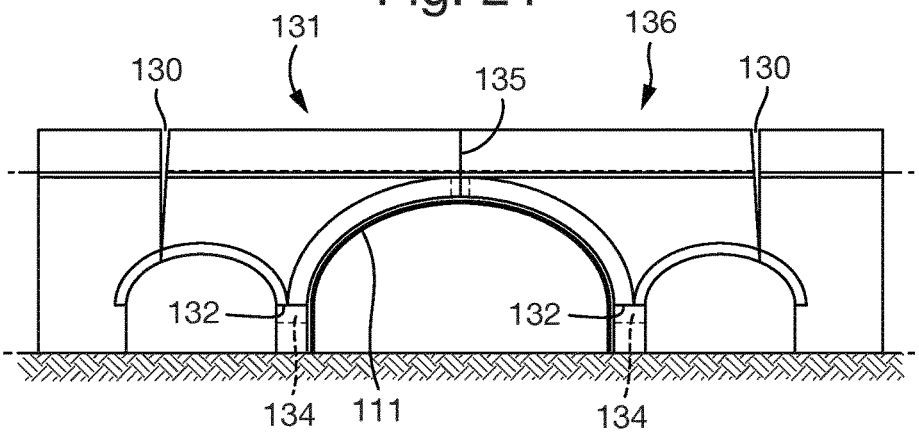

With reference to FIG. 21, all of the jacks (both the vertically orientated jacks in pockets 134 and the horizontally orientated jacks in the cores 150) are loaded. The remaining masonry between the pockets 134 is then cut, forming horizontal cuts 132. This may be done using a wire saw. The masonry between the cores 150 may be cut at this time or may have been cut prior to jack loading. The cut in the crown 135, the wedges 130 and the horizontal cuts 132 thus form first and second moveable portions 131, 136 of the masonry arch bridge 101.

Figure 22:
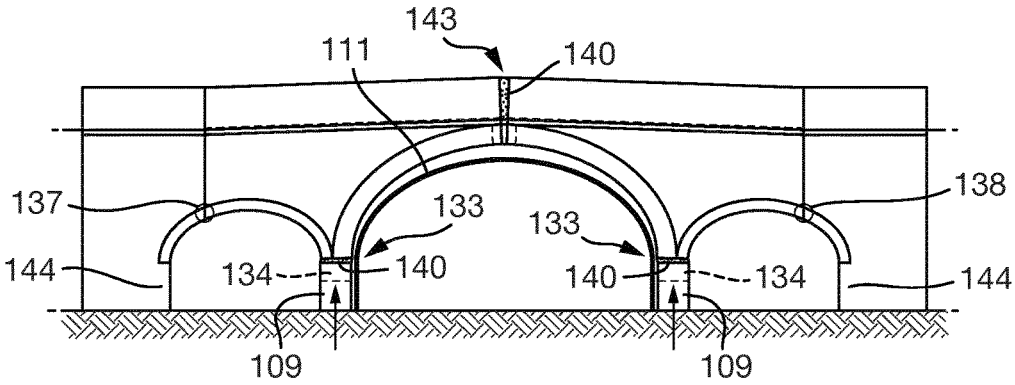

With reference to FIG. 22, the method further comprises jacking the first and second moveable portions 131, 136 using jacks 115 located in the jacking pockets 134. The first and second moveable portions 131, 136 pivot about respective first and second pivot points 137, 138. The first and second pivot points 137, 138 (and the wedges 130) are located at a position one-quarter of the span of the side arches 116, 117 from the outer lateral extremity of the respective side arches. The tip of the wedge-shaped gap 130 is positioned at the pivot point 137, 138.

Upon lifting, gaps 133 are formed between the masonry arches 103, 116, 117 and the piers 109. A crown gap 143 is also formed between the two movable portions 131, 136. To ensure arch compression is maintained during jacking, the horizontal jacks located in the cores 150 are inflated during jacking. Further, in addition to the vertical and horizontal jacks, shim wedges (not shown) may be inserted adjacent the vertical and horizontal jacks 115 (e.g. in the cores 150, the jacking pockets 134, the horizontal cut 132 and/or the crown cut 135) to support the masonry arch during lifting.

A wedge, masonry, mortar and/or grout 140 is installed to fill gaps 133, 143. This is allowed to cure and the jacks 115 are de-jacked. This may be achieved by using grout bags that are inserted into the gaps 133, 143 and inflated/filled with grout. Once the jacks are removed, the jacking pockets 134 and the cores 150 can be filled.

Figure 23:
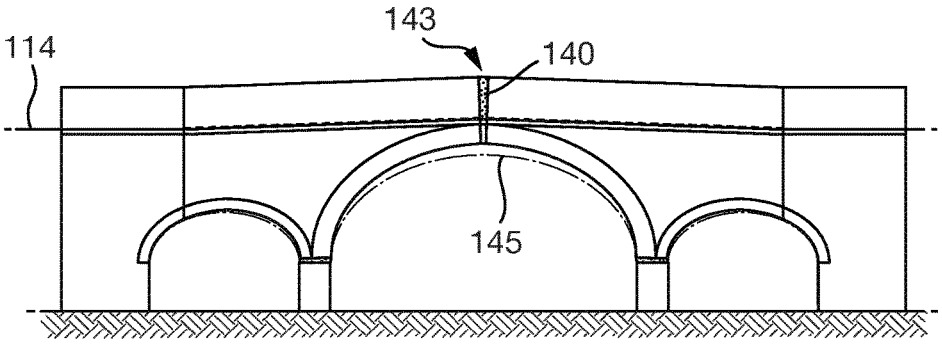

With reference to FIG. 23, the method further comprises backfilling the excavated region, preferably with foamed concrete, the previously excavated material or new graded backfill material. The road level 114 may be adjusted to a suitable level. The brickwork can be checked and made good if necessary. The original profile 145 of the bridge can be seen as being lower than the raised profile. The netting and shield 111 are also removed.

Figure 24:
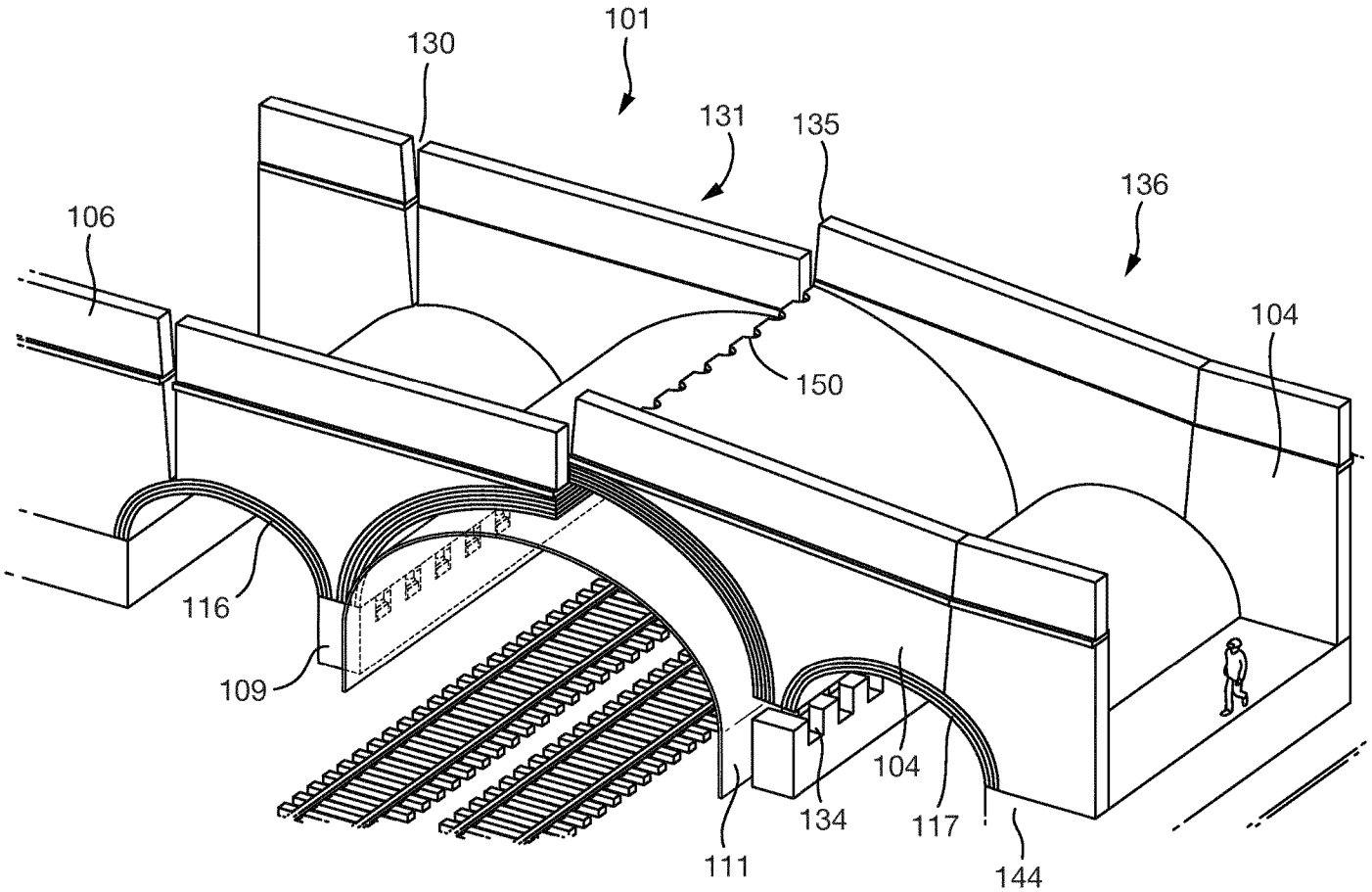
Figure 25:
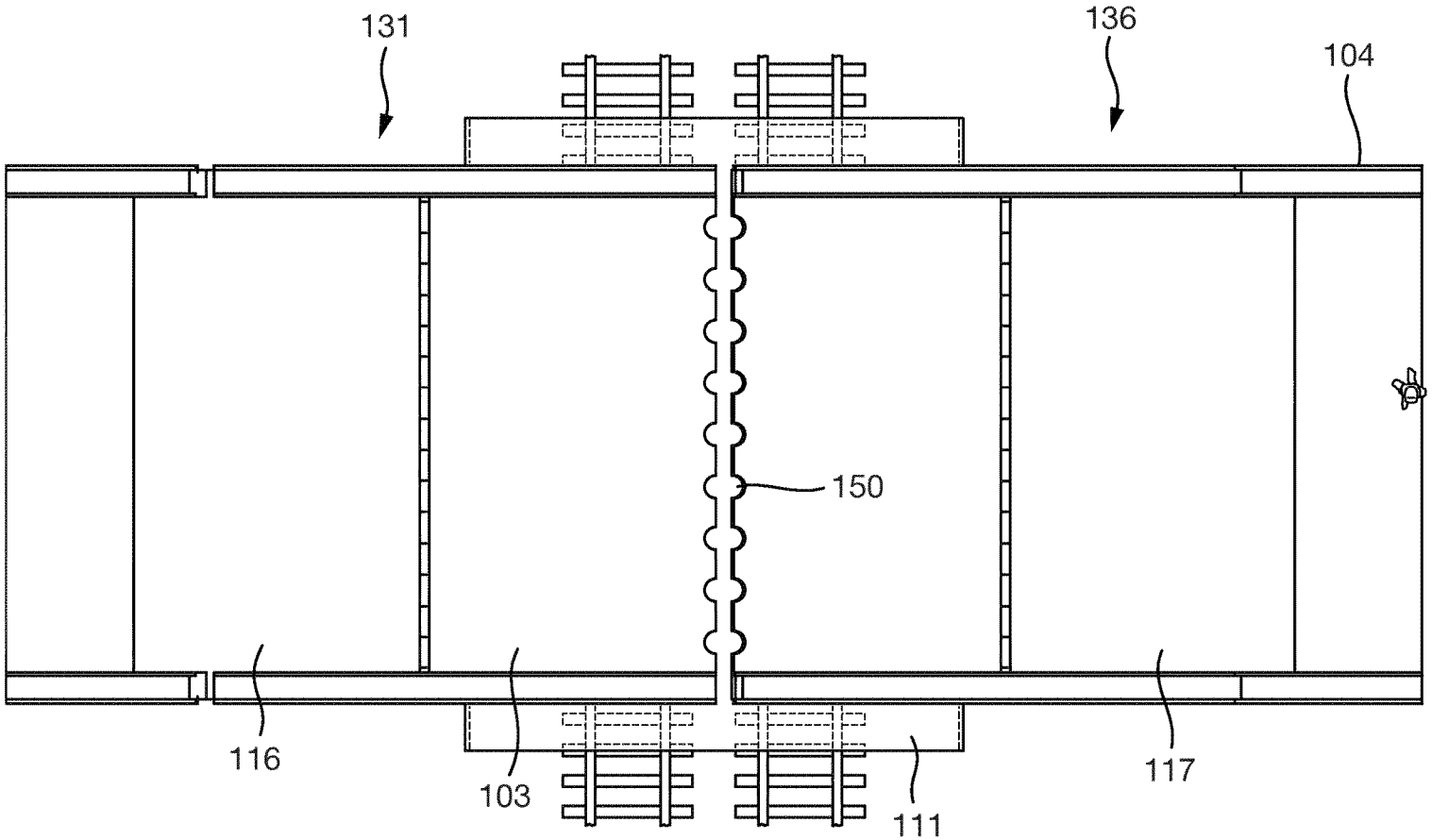

FIGS. 24 and 25 provide other views of the excavated masonry bridge 101, showing the central masonry arch 103, the first side masonry arch 116, the second side masonry arch 117, the spandrel walls 104, the parapets 106, the piers 109, the outer piers 144, the jacking pockets 134, the cores 150, the crown cut 135, the moveable portions 131, 136, the shield 111 and the wedge-shaped gaps 130.

Figure 26:
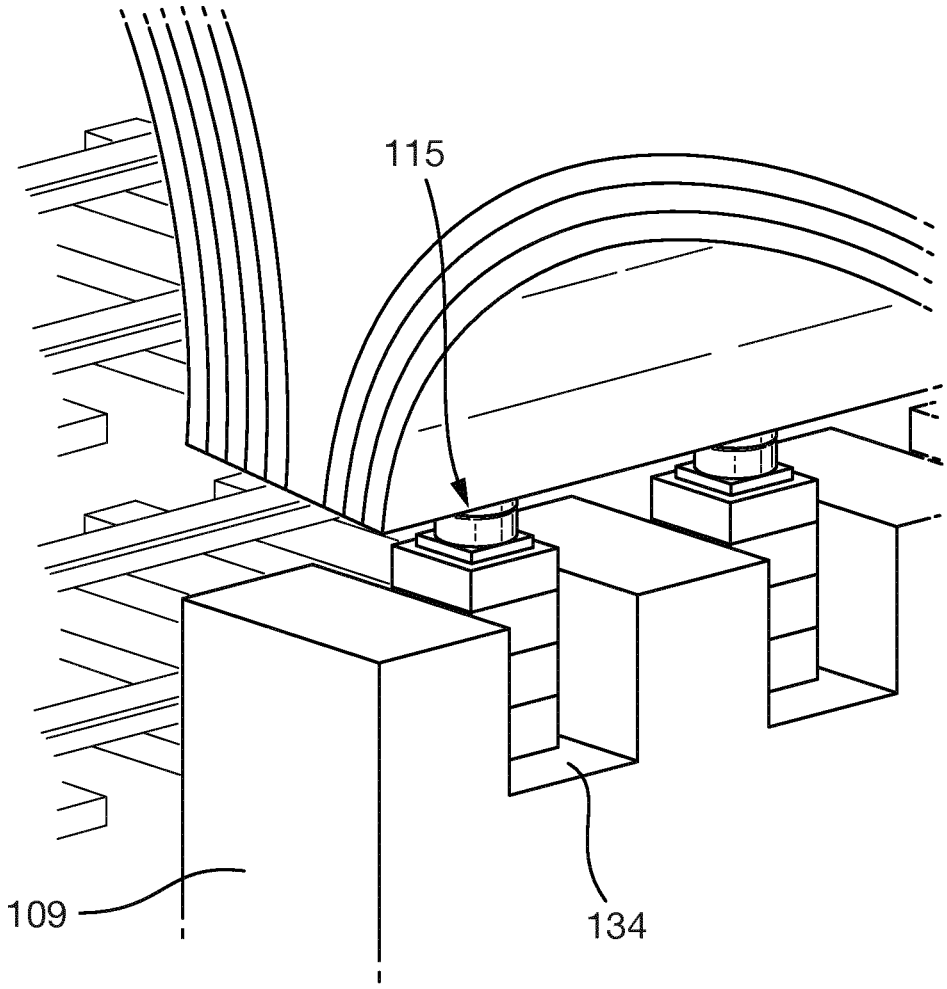

FIG. 26 shows the jacking mechanism in more detail. A plurality of jacks 115 are positioned in respective jacking pockets 134 in the piers 109.

Figure 27:
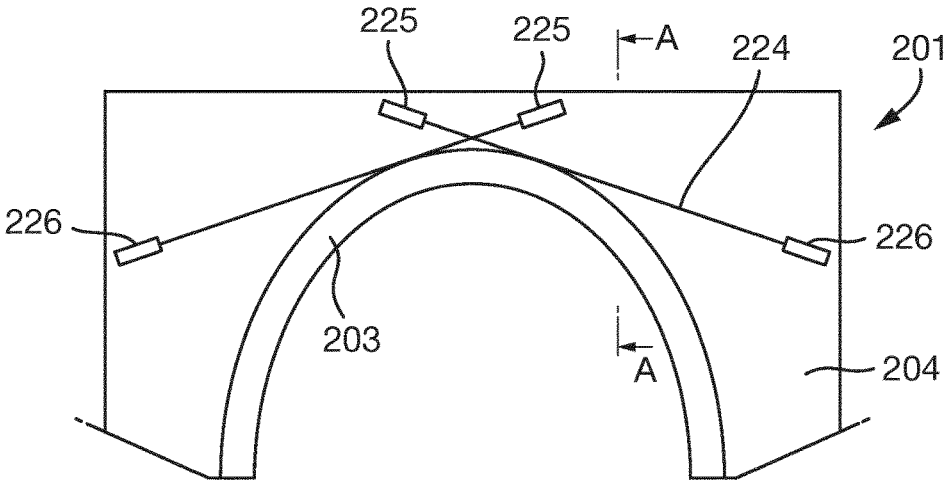
FIGS. 27 to 29 illustrate a method of strengthening the masonry arch.

FIG. 27 illustrates an alternative strengthening means. In this embodiment, the strengthening means is applied by anchoring tendons 224 to the masonry arch bridge 201 and applying a tensioning force to the tendons. As can be seen, first and second tendons 224 overlap in the lateral direction in the region of the crown of the masonry arch 203.

The tendons may be anchored to the spandrel wall 204. One end of each tendon 224 is anchored to one side of the crown, and the other end of each tendon 224 is anchored to the other side of the crown. The tendons 224 are upwardly inclined in an inward lateral direction. One tendon extends from an upper anchor position 225 on a first side of the crown and another tendon extends from an upper anchor position 225 on a second side of the crown. The tendons may extend to respective lower anchor positions 226. The upper anchor positions 225 are live ends, the lower anchor positions 226 are dead ends. The angle each tendon 224 makes with the horizontal is approximately equal.

Figure 28:
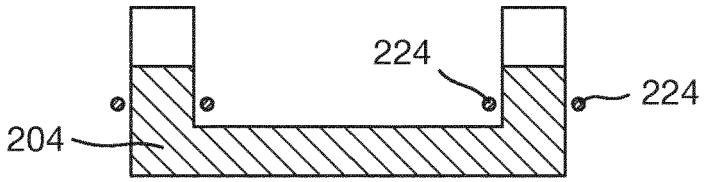

As shown in FIG. 28, which shows one example of section A-A, four tendons may be used, one attached to each surface of the spandrel walls 204.

Figure 29:
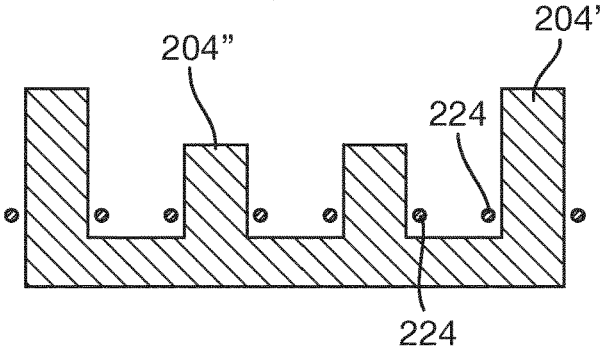

As shown in FIG. 29, which shows another example of section A-A, the masonry arch bridge 201 may comprise outer spandrel walls 204' inner spandrel walls 204". Further tendons 224 are attached to the inner spandrel walls 204'.

Figure 30:
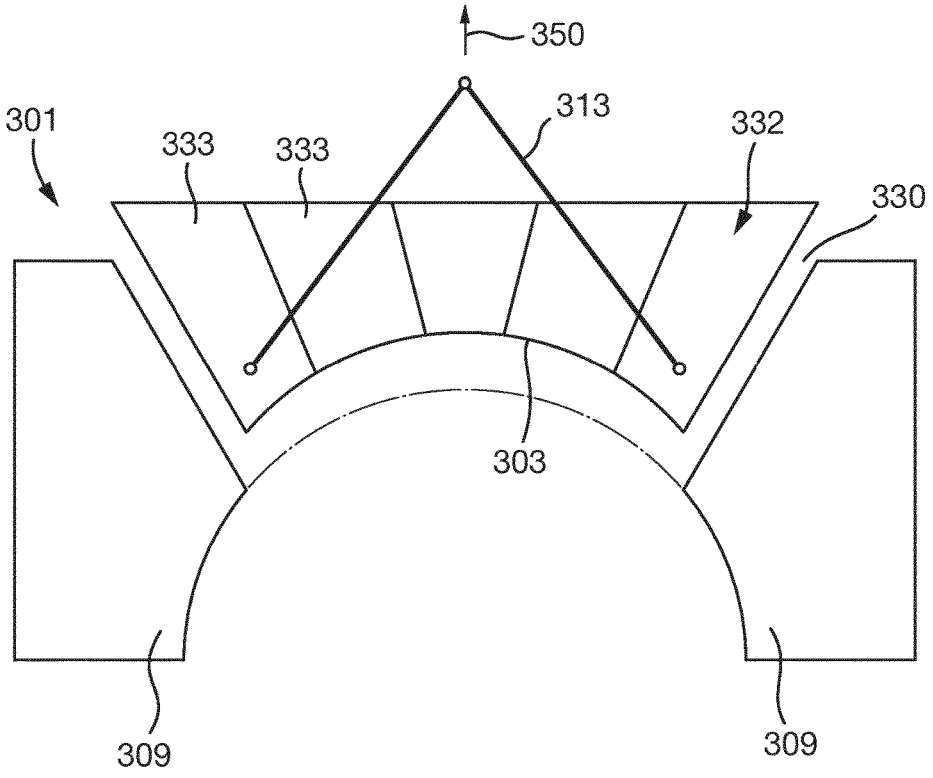
FIGS. 30 and 31 illustrate respective methods of lifting the masonry arch without added strengthening.

Another embodiment of the method is illustrated in FIG. 30. As shown, in this embodiment, a moveable portion 332 is formed by cuts 330 which may be inclined in a laterally outward direction. The cuts 330 extend from a masonry arch 303 to the upper surface of the bridge 301. Lifting devices 313 are attached to the lower portions of the moveable portion 332, preferably the lower-most block of the masonry. Further, the lifting devices are angled inward toward a point above the crown of the arch 303. The lifting devices may meet at this point or may be attached to a lifting beam or frame. As the moveable portion is lifted vertically by lifting force 350, the masonry is also subjected to a compression force since, due to the positioning of the lifting devices 313, there is a component of the lifting which acts to compress the masonry. Further, since the moveable portion 332 is being lifted from its lower portion, arch action continues to act to maintain the structural integrity of the masonry arch 303 during the lift. Although not shown in FIG. 30, the gap formed between the moveable portion 332 and the remainder of the bridge 301 can be filled after the lift to maintain the moveable portion in its raised position. Once this has occurred, the lifting force 350 may be removed and arch action continues to maintain the structural integrity of the masonry arch 303 now in its raised position. The masonry 333 of the masonry arch 303 is shown in enlarged schematic form. As shown in FIG. 30, the lifting devices 313 are lifting strands.

Figure 31:
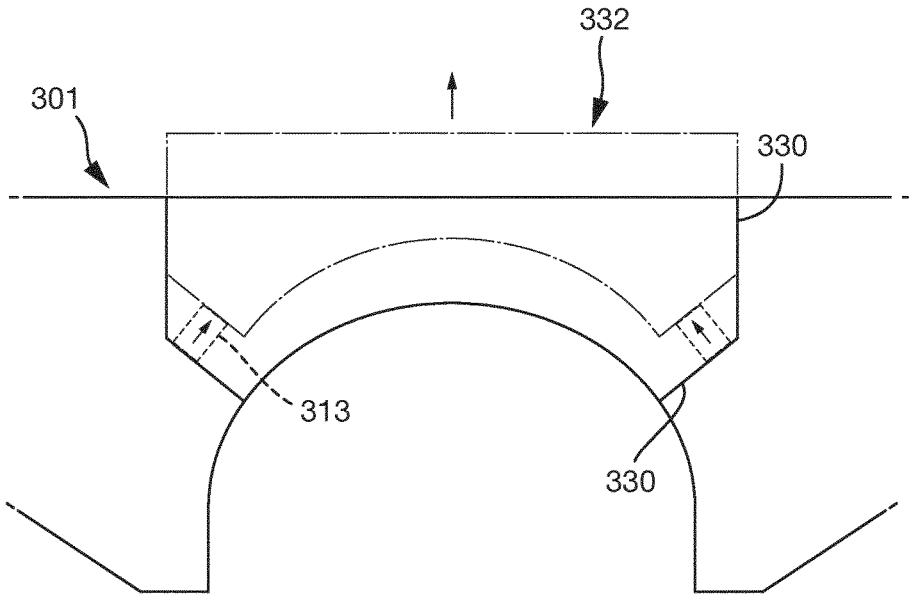

However, alternatively (or additionally to the lifting from above shown in FIG. 30), as shown in FIG. 31, the lifting devices 313 may be provided by jacks. These jacks are inclined. The jacks are positioned between the moveable portion 332 and the remainder of the bridge 301 in the cuts 330.

Figure 32:
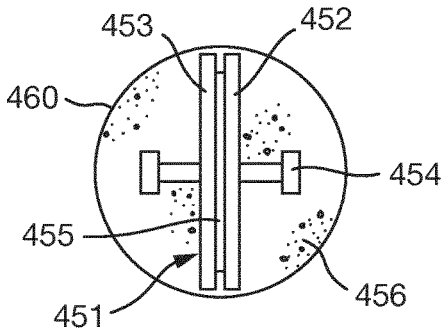
FIGS. 32 to 34 illustrate another embodiment of the present invention.
Figure 33A:
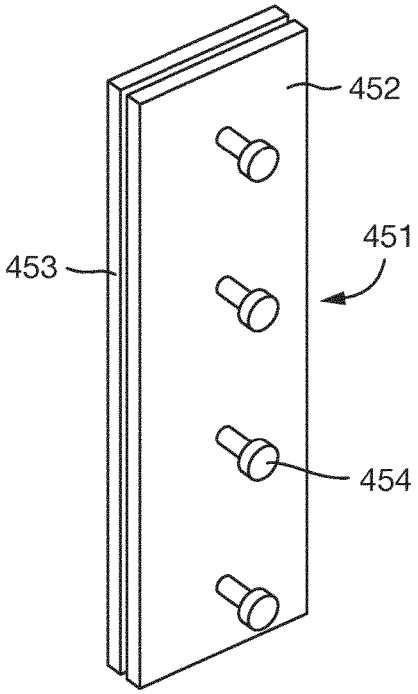
Figure 33B:
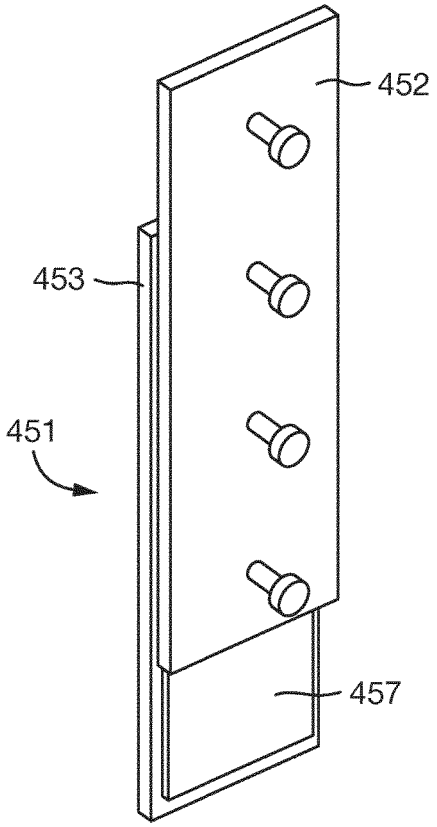
Figure 34A:
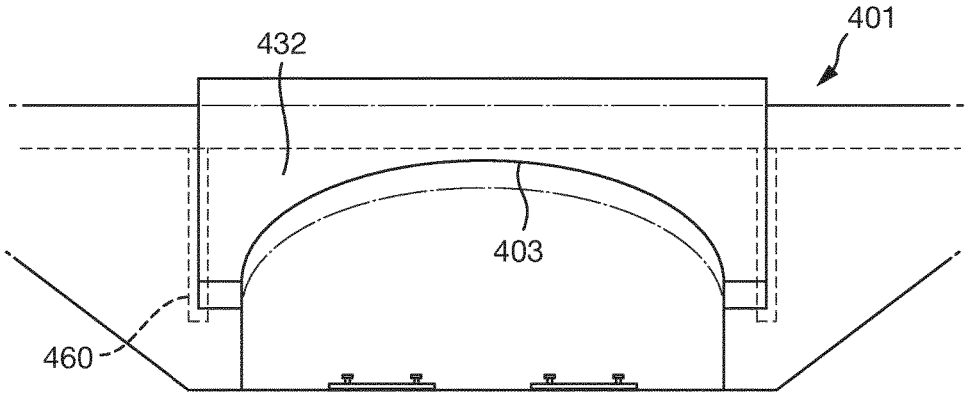
Figure 34B:
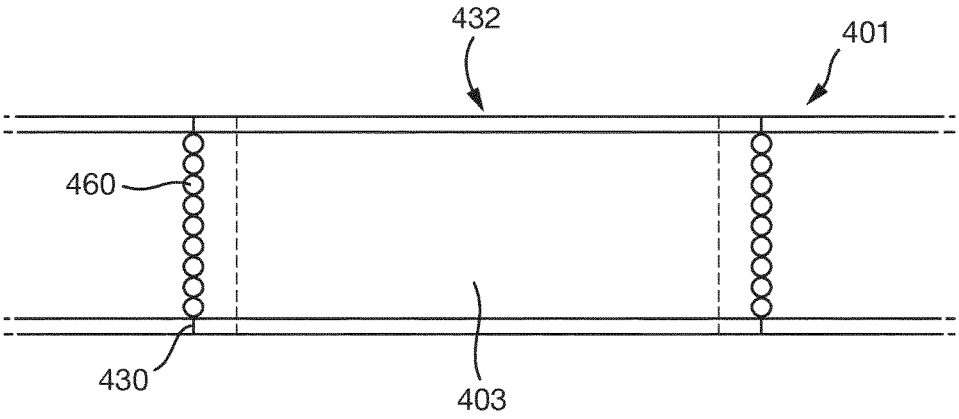

FIGS. 32 to 34 show an embodiment of the present invention in which a bearing 451 is provided at the laterally outward sides of a moveable portion 432.

FIG. 32 shows a plan view of such a bearing 451.

FIGS. 33(*a*) and (*b*) schematically shows the bearing 451 without the surrounding grout/concrete 456. A planar portion 452 slides upwards, but remains in contact with, another planar portion 453. FIG. 33(*a*) shows the relative positions of the two planar portions 452, 453 before lifting and FIG. 33(*b*) shows the relative positions of the two planar portions 452, 453 after lifting.

FIGS. 34(*a*) and (*b*) shows the location of the cored holes 460 in relation to the cut 430 and the moveable portion 432. FIG. 34(*a*) shows a side-on view of the bridge 401 and FIG. 34(*b*) shows a plan view of the bridge 401.

The bearing 451 acts to maintain compression and hence arch action of the masonry arch 403. The bearing 451 also reduces friction and allows for a more controlled lift. This is achieved by having a cut 430 comprising a plurality of cored holes 460. The cored holes 460 are substantially vertical. The cored holes 460 have a generally circular cross-sectional shape. The cored holes 460 are positioned adjacent one another and collectively extend along substantially the entire longitudinal length (i.e. in a horizontal direction) of the cut 430. The cored holes 460 are not present in the spandrel walls.

A bearing 451 is located in each of the cored holes 460. The bearing 451 comprises two planar portions 452, 453 which are substantially identical to one another. The width of the planar portions 452, 453 is substantially the same as the diameter of the cored holes 460. The length of the planar portions 452, 453 is substantially the same as the depth of the cored holes 460.

The bearing 451 comprises a friction reducing means 455, such as grease. The friction reducing means 455 is located between planar portions 452, 453. The friction reducing means 455 has an area that is substantially similar to that of the planar portions 452, 453.

The planar portion 452 is attached to the moveable portion 432 by grout/concrete 456. The planar portion 452 is attached to the grout/concrete 456 by pegs 454. The pegs 454 are embedded in the grout/concrete 456. The bearing 451 may be positioned in the cored hole 460, and the grout/concrete 456 is then poured into the cored hole 460 and allowed to set around the pegs 454. Planar portion 453 is attached to the remainder of the bridge 401 in a similar fashion.

When in use, the planar portions 452, 453 are in slidable contact with one another. Thus, as the moveable portion 432 is lifted (by any of the above-discussed methods) the planar portion 453 provides a lateral support to the planar portion 452. The planar portion 452 provides a lateral support to the moveable portion 432. The bearing 451 thus provides a lateral reaction force to the moveable portion 432, and helps to maintain the form of the moveable portion 432 and the remainder of the masonry arch bridge 401.

As shown in FIG. 33(*b*), the bearing may contain a compressible material, such as rubber, 457 which can accommodate minor mis-alignment of the bearing 451 with respect to the intended slip plane whilst still maintaining pressure across the slip plane.

The invention claimed is:

1. A method of enlarging the space beneath a masonry arch bridge, the masonry arch bridge comprising a masonry arch and a spandrel wall at each end of the masonry arch, the method comprising forming a moveable portion of the masonry arch bridge by cutting the spandrel walls to form a cut on each side of the masonry arch, applying a lifting force to the moveable portion to raise the masonry arch to a raised position, and securing the masonry arch in the raised position.

2. A method as claimed in claim 1, wherein no strengthening means is applied to the masonry arch prior to lifting.

3. A method as claimed in claim 1, wherein a strengthening means is applied to the masonry arch prior to lifting.

4. A method as claimed in claim 3, wherein applying the strengthening means comprises applying a compressive force to the masonry arch.

5. A method as claimed in claim 3, wherein the strengthening means is applied by anchoring one or more tendons relative to the masonry arch and applying a tensioning force to the tendon(s).

6. A method as claimed in claim 5, wherein a first and a second tendon overlap in a lateral direction in a region above a crown of the masonry arch.

7. A method as claimed in claim 3, wherein the strengthening means comprises a saddle, and wherein the saddle is applied to an upper surface of the masonry arch.

8. A method as claimed in claim 7, wherein applying the saddle to the upper surface of the masonry arch comprises casting a reinforced concrete saddle to the upper surface of the masonry arch and allowing the concrete to cure.

9. A method as claimed in claim 8, wherein applying the saddle to the upper surface of the masonry arch further comprises post-tensioning the reinforced concrete saddle.

10. A method as claimed in claim 3 wherein the strengthening means comprises one or more devices being located and orientated to apply a force to the masonry arch, the force having at least a component in the horizontal direction.

11. A method as claimed in claim 3, wherein:

the masonry arch bridge is a multi-span masonry arch bridge comprising one or more additional masonry arches and respective one or more piers between adjacent masonry arches; and the strengthening means is applied to the additional masonry arch(es).

12. A method as claimed in claim 1, further comprising providing a bearing in the cut.

13. A method as claimed in claim 1, further comprising, prior to applying the lifting force:

forming wedge-shaped gaps in the spandrel walls laterally outward of the masonry arch;

forming first and second moveable masonry arch portions by cutting through the masonry arch.

14. A method as claimed in claim 13, wherein securing the masonry arch in the raised position comprises inserting or forming a wedge between the first and second moveable masonry arch portions.

15. A method as claimed in claim 1, wherein during lifting the lifting force is applied such that arch action of the masonry arch is sufficiently maintained to ensure that the masonry arch maintains its structural integrity.

16. A method as claimed in claim 1, wherein the lifting force is provided at a lower portion of the masonry arch.

17. A method of enlarging the space beneath a masonry arch bridge, the masonry arch bridge comprising a masonry arch and a spandrel wall at each end of the masonry arch, the method comprising applying a strengthening means to the masonry arch, applying a lifting force to the masonry arch to raise the masonry arch to a raised position, and securing the masonry arch in the raised position wherein the strengthening means comprises at least one of:

one or more tendons, wherein the one or more tendons are applied by anchoring the one or more tendons relative to the masonry arch and applying a tensioning force to the tendon(s);

a saddle, wherein the saddle is applied to an upper surface of the masonry arch; and one or more devices being located and oriented to apply a force to the masonry arch, the force having at least a component in the horizontal direction.

18. A method as claimed in claim 17, further comprising, prior to applying the lifting force, forming a moveable portion of the masonry arch bridge by cutting the spandrel walls to form a cut on each side of the masonry arch.

19. A masonry arch bridge comprising a masonry arch having an upper surface, a spandrel wall at each end of the masonry arch, and a strengthening means applied to the masonry arch wherein the strengthening means comprises at least one of:

one or more tendons anchored relative to the masonry arch;

a saddle applied to the upper surface of the masonry arch; and one or more devices being located and orientated to apply a force to the masonry arch, the force having at least a component in the horizontal direction.

* * * * *